US008579279B2

(12) United States Patent
Kagoshima et al.

(10) Patent No.: US 8,579,279 B2
(45) Date of Patent: Nov. 12, 2013

(54) CONVEYING DIRECTION-SWITCHING DEVICE FOR PAPER LEAVES WITH DIRECTION-CHANGING DRUM

(75) Inventors: Kazuhiro Kagoshima, Inagi (JP); Hiroshi Yanagida, Inagi (JP); Ryosuke Ebinuma, Inagi (JP)

(73) Assignee: Fujitsu Frontech Limited, Tokyo (JP)

( * ) Notice: Subject to any disclaimer, the term of this patent is extended or adjusted under 35 U.S.C. 154(b) by 198 days.

(21) Appl. No.: 12/948,245

(22) Filed: Nov. 17, 2010

(65) Prior Publication Data

US 2011/0156335 A1 Jun. 30, 2011

(30) Foreign Application Priority Data

Dec. 25, 2009 (JP) ..... 2009-293663

(51) Int. Cl.
*B65H 29/60* (2006.01)

(52) U.S. Cl.
CPC ..... *B65H 29/60* (2013.01)
USPC ..... 271/185; 271/225

(58) Field of Classification Search
USPC ..... 271/225, 184–187
See application file for complete search history.

(56) References Cited

U.S. PATENT DOCUMENTS

| | | | | |
|---|---|---|---|---|
| 4,871,163 | A * | 10/1989 | Landa et al. | 271/225 |
| 5,628,258 | A * | 5/1997 | Zwahlen et al. | 271/303 |
| 5,836,577 | A | 11/1998 | Arikawa et al. | |
| 5,868,387 | A * | 2/1999 | Kida et al. | 271/186 |
| 7,093,831 | B2 * | 8/2006 | Biegelsen et al. | 271/184 |
| 2004/0150158 | A1 * | 8/2004 | Biegelsen et al. | 271/303 |
| 2010/0090397 | A1 | 4/2010 | Taniguchi | |

FOREIGN PATENT DOCUMENTS

| | | | |
|---|---|---|---|
| JP | 60-187163 | U * | 12/1985 |
| JP | 02-81857 | A | 3/1990 |
| JP | 08-002774 | A | 1/1996 |
| JP | 09-293160 | A | 11/1997 |
| JP | 2006-127131 | A | 5/2006 |
| JP | 2006-127132 | A | 5/2006 |
| JP | 2008-280119 | A | 11/2008 |
| JP | 2009-292606 | A | 12/2009 |

OTHER PUBLICATIONS

Office Action dated Apr. 3, 2013 issued in the corresponding Chinese Patent Application 201010579885.7. English Translation.
Office Action dated Oct. 1, 2013 in Japanese Patent Application No. 2009-293663. Partial translation (5 pages).

* cited by examiner

*Primary Examiner* — Gerald McClain
(74) *Attorney, Agent, or Firm* — Westerman, Hattori, Daniels & Adrian, LLP

(57) ABSTRACT

A conveying direction-switching device is formed by direction-changing drums each having the same hollow cylindrical shape having a length corresponding to a lateral width of paper money bills to be conveyed. The direction-changing drum has first to fourth openings arranged in the outer periphery thereof, in a manner spaced from each other by a rotational angle of 90 degrees, and the rotational angle position thereof is controlled to be a predetermined phase angle. Inside the direction-changing drum, the first opening and the fourth opening are connected by a paper money guide forming a first curved passage, the second opening and the fourth opening are connected by a paper money guide forming a straight passage, and the third opening and the fourth opening are connected by a paper money guide forming a second curved passage.

2 Claims, 6 Drawing Sheets

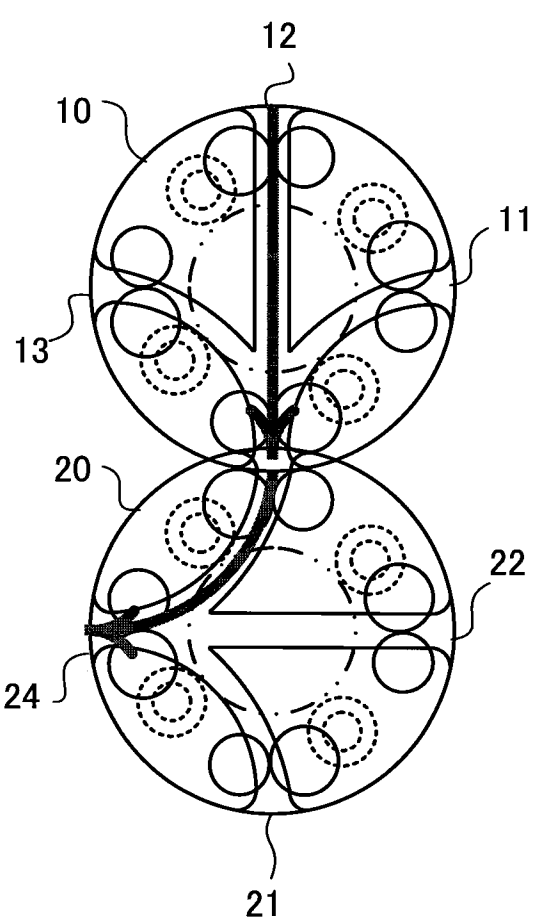
FIG. 3A
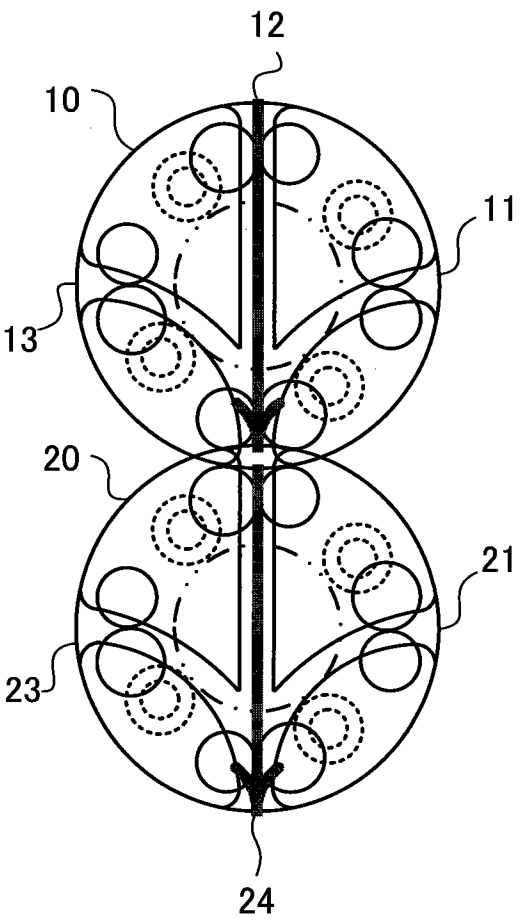
FIG. 3B
FIG. 3C

CONVEYING DIRECTION-SWITCHING DEVICE FOR PAPER LEAVES WITH DIRECTION-CHANGING DRUM

CROSS-REFERENCE TO RELATED APPLICATION

This application is based upon and claims the benefit of priority of the prior Japanese Patent Application No. 2009-293663, filed on Dec. 25, 2009, the entire contents of which are incorporated herein by reference.

FIELD

The embodiments discussed herein are related to a conveying direction-switching device for paper leaves, which switches the conveying direction of paper leaves, such as paper money bills or the like, between three directions, during conveyance thereof, a conveying direction control method, and a paper leaves processor.

BACKGROUND

In a paper money receiving and dispensing apparatus that performs processing for receiving and dispensing paper money bills, when storing received paper money bills into predetermined storage cassettes or the like according to the type of each paper money bill, or dispensing paper money bills from stored paper money bills, it is necessary to convey the bills in multiple directions. For this reason, in automatic telling machines (ATMs) of banks, automatic vending machines, automatic ticket machines, etc., a conveying direction-switching device has conventionally been used for switching the direction of conveying each paper money bill being conveyed one way from a bill inlet, e.g. between a vertical direction and a horizontal direction.

However, to realize a paper money conveying gate which is capable of switching the conveying direction between two or more directions, a complicated gate mechanism or pathway has been necessary, and hence the number of components becomes larger, which complicates the manufacturing process. To eliminate this inconvenience, there has been proposed a conveying system in which a method of switching back a paper money bill within one conveying path is employed as a measure for simplifying the switching mechanism.

A conveyance-branching mechanism disclosed in Japanese Laid-open Patent Publication No. 2008-280119 (Paragraphs [0039] to [0052], FIG. 1 and the like) is capable of bi-directionally conveying paper money bills using a first conveying path 24 and a second conveying path 25 opposed to each other, and at the same time conveying a paper money bill conveyed from the first conveying path 24 or the second conveying path 25 into one of conveying paths branched off in multiple directions. In this mechanism, a branching member is swingably provided at an intersection of four conveying paths 24 to 27, and a stepping motor 56 controls a stop position of the branching member, for selection of a conveying path.

Further, a circulation-type paper money receiving and dispensing machine disclosed in Japanese Laid-open Patent Publication No. 2006-127131 (Paragraphs [0100] to [0104], FIG. 9 and the like) is configured such that a clerk can refill and collect paper money bills from a rear side of the machine, and a customer can insert paper money bills to be deposited and take out dispensed paper money bills from a front side of the machine, whereby the deposited bills are cyclically used for the bills for dispensing. In this machine, for the purpose of cyclic use of bills, a guide member is used which has a rectilinear conveyance guiding surface and a turning direction guiding surface. This simplifies the construction of a three-direction switching mechanism provided at an intersection conveying path, for switching the conveying direction of bills between three directions, and thereby also simplifies the arrangement of paper money-conveying paths.

However, in the conventional paper money processors, in general, the conveying direction is switched by driving gates which advance into and retract from the paper money-conveying paths based on a result of identification of a type of each inserted paper money bill. As a consequence, each gate is capable of switching the conveying direction between only two directions. Therefore, for the guide member to realize the switching of the conveying direction between three directions, e.g. a direction in which an inserted bill is stored, a direction in which an inserted bill is returned from a return slot, and a direction in which a stored bill is dispensed from the return slot, it is necessary to provide two gates and three conveying paths. Therefore, there has been a problem that the number of component parts of a conventional paper leaves processor becomes larger to cause an increase in costs and provide an impediment to the downsizing of the processor.

Further, if the number of destinations of conveyed paper money bills is increased, this further complicates the arrangement of the paper money-conveying paths. Further, it is necessary to arrange conveyance-switching sections according to the number of the conveying paths. Therefore, if it is necessary to detect a paper money bill in the vicinity of each conveyance-switching section or on each conveying path, the whole conveying mechanism becomes complicated and is increased in size, so that not only the costs are increased but also maintenance and inspection become difficult.

SUMMARY

According to an aspect of the invention, there is provided a conveying direction-switching device that switches the direction of conveying paper leaves. This conveying direction-switching device includes a direction-changing drum configured to have a plurality of openings formed in an outer periphery thereof for permitting a paper leaf to be conveyed therein and be conveyed therefrom, and have a plurality of conveying paths formed therein for connection between the openings, and a control unit configured to control the direction-changing drum to a predetermined phase angle about a rotational axis thereof, to thereby cause one of the openings to be aligned with a conveying direction of the paper leaf conveyed into the direction-changing drum, wherein one of a plurality of directions is selected as the direction of conveying the paper leaf to be discharged from one of the openings according to the predetermined phase angle of the direction-changing drum.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIGS. 2A and 2B illustrate a conveying direction-switching device according to the present embodiment, which uses two direction-changing drums, in which FIG. 2A is a plan view of the entire arrangement of the conveying direction-switching device, and FIG. 2B is a cross-sectional view of the arrangement of a gate formed by the direction-changing drums, taken along B-B of FIG. 2A;

FIGS. 3A to 3C are views illustrating respective flows of a paper money bill from above to right below, below and right below through selected ones of various paper money-conveying paths formed by the two direction-changing drums arranged one on the other, by way of example;

DESCRIPTION OF EMBODIMENT(S)

Figure 1:
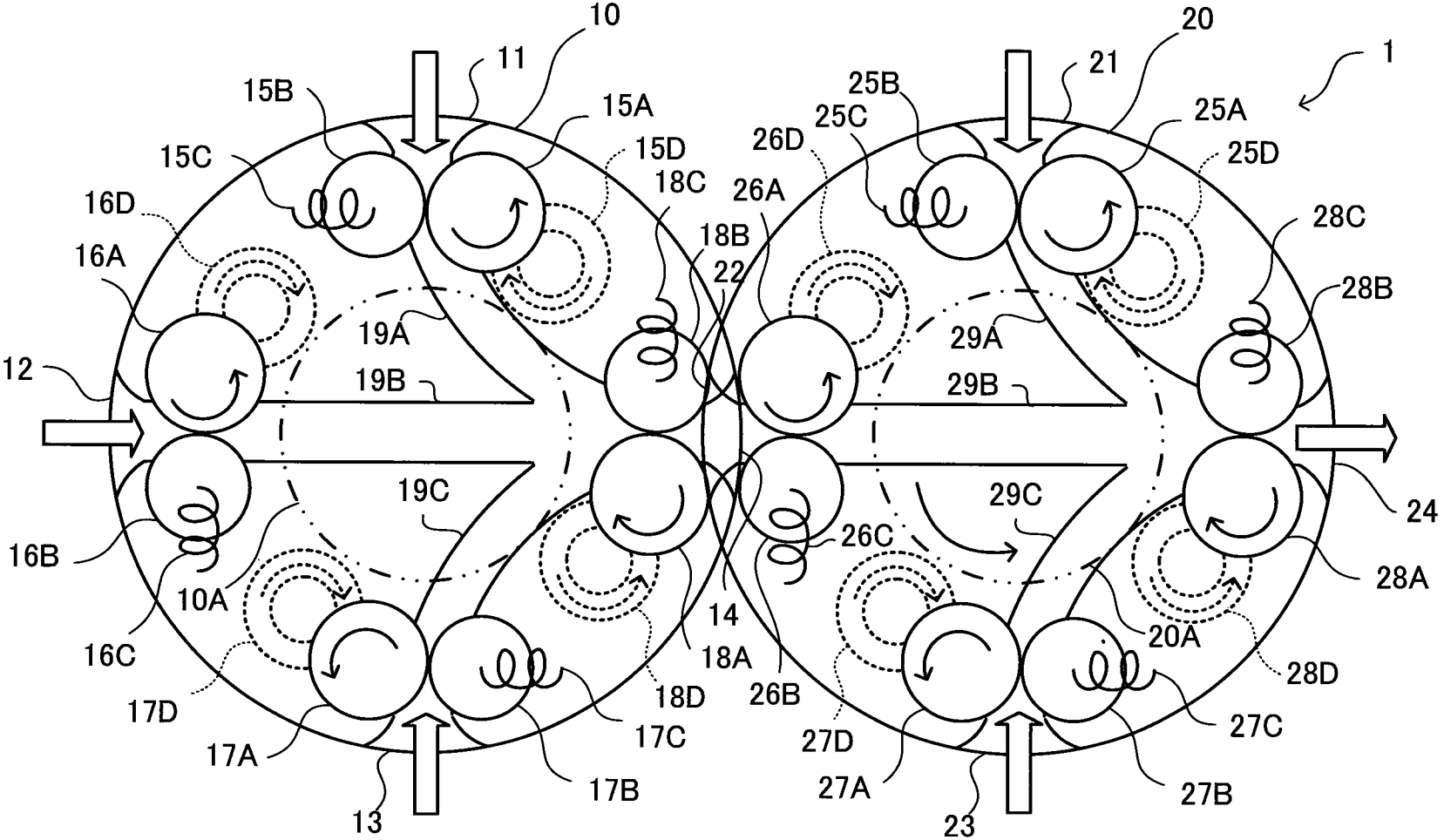
FIG. 1 is a cross-sectional view of the arrangement of a gate formed by a combination of two conveying direction-switching devices each according to the present invention.

Embodiments of the present invention will be explained below with reference to the accompanying drawings, wherein like reference numerals refer to like elements throughout. FIG. 1 is a cross-sectional view of the arrangement of a gate formed by a combination of two conveying direction-switching devices according to the present invention.

A conveying direction-switching device 1 according to an embodiment comprises the two direction-changing drums 10 and 20 each having an identical hollow cylindrical shape having a length corresponding to the lateral width of a paper money bill to be conveyed, and is illustrated in a state where the two direction-changing drums 10 and 20 convey a paper money bill conveyed into the gate from one of left, upper and lower sides, toward the right, as viewed in FIG. 1. The first direction-changing drum 10 has a drive gear 10A disposed at a longitudinal end thereof at a location toward the rear as viewed in FIG. 1, and has a phase control motor (not illustrated), referred to hereinafter, coaxially arranged at the other longitudinal end thereof at a location toward the front as viewed in FIG. 1, whereby the rotational angle position of the first direction-changing drum 10 is controlled to a predetermined phase angle. Further, the first direction-changing drum 10 has first to fourth openings 11 to 14 formed in an outer periphery thereof in a manner spaced from each other by a rotational angle of 90 degrees.

These openings 11 to 14 each have a slit-like shape the longitudinal direction of which is parallel to the rotational axis of the first direction-changing drum 10. Further, the openings 11 to 13 each form a paper money convey-in path, and the opening 14 forms a paper money convey-out path. In the respective vicinities of the openings 11 to 13 which form the first to third paper money convey-in paths, drive rollers 15A to 17A for conveying paper money bills into the first direction-changing drum 10 are journaled at respective locations slightly inward of the outer periphery of the first direction-changing drum 10, thereby forming first to third paper money convey-in mechanisms, respectively. Further, similarly, in the vicinity of the fourth opening 14 which forms the paper money convey-out path, a drive roller 18A for discharging a paper money bill is journaled at a location slightly inward of the outer periphery of the first direction-changing drum 10.

Inside the first direction-changing drum 10, the first opening 11 and the fourth opening 14 are connected by a paper money guide 19A which forms a first curved passage. Further, the second opening 12 and the fourth opening 14 are connected by a paper money guide 19B which forms a straight passage, and the third opening 13 and the fourth opening 14 are connected by a paper money guide 19C which forms a second curved passage. The drive rollers 15A to 18A disposed in the vicinity of the four openings 11 to are provided with pinch rollers 15B to 18B, respectively, so as to pinch paper money bills passing through the paper money guides 19A to 19C in a state urged by springs 15C to 18C, respectively. Further, at these openings 11 to 14, transmission gears 15D to 18D indicated by dotted lines are interposed between the drive gear 10A and the drive rollers 15A to 18A such that the drive rollers 15A to 18A are each driven for rotation in a predetermined direction.

The second direction-changing drum 20 adjacent to the first direction-changing drum 10 also has a drive gear 20A disposed at one longitudinal end thereof at a location toward the rear as viewed in FIG. 1, and has a phase control motor (not illustrated), referred to hereinafter, coaxially arranged at the other longitudinal end thereof at a location toward the front as viewed in FIG. 1, whereby the rotational angle position of the second direction-changing drum 20 is controlled to a predetermined phase angle. Further, the second direction-changing drum 20 has first to fourth openings 21 to 24 in an outer periphery thereof, in a manner spaced from each other by a rotational angle of 90 degrees. In the respective vicinities of the openings 21 to 24, drive rollers 25A to 28A, pinch rollers 25B to 28B, springs 25C to 28C, transmission gears 25D to 28D, and paper money guides 29A to 29D are arranged, respectively, similarly to the respective corresponding parts being arranged in the respective vicinities of the openings 11 to 14 of the first direction-changing drum 10.

Figure 2B:
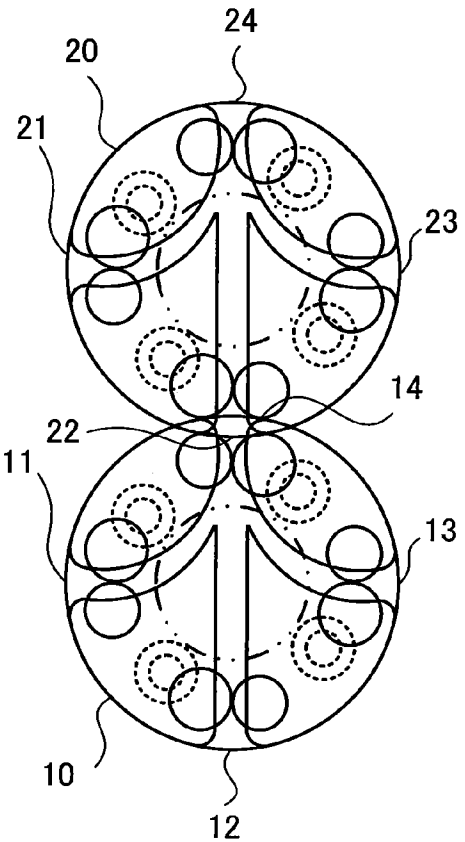
Figure 2A:
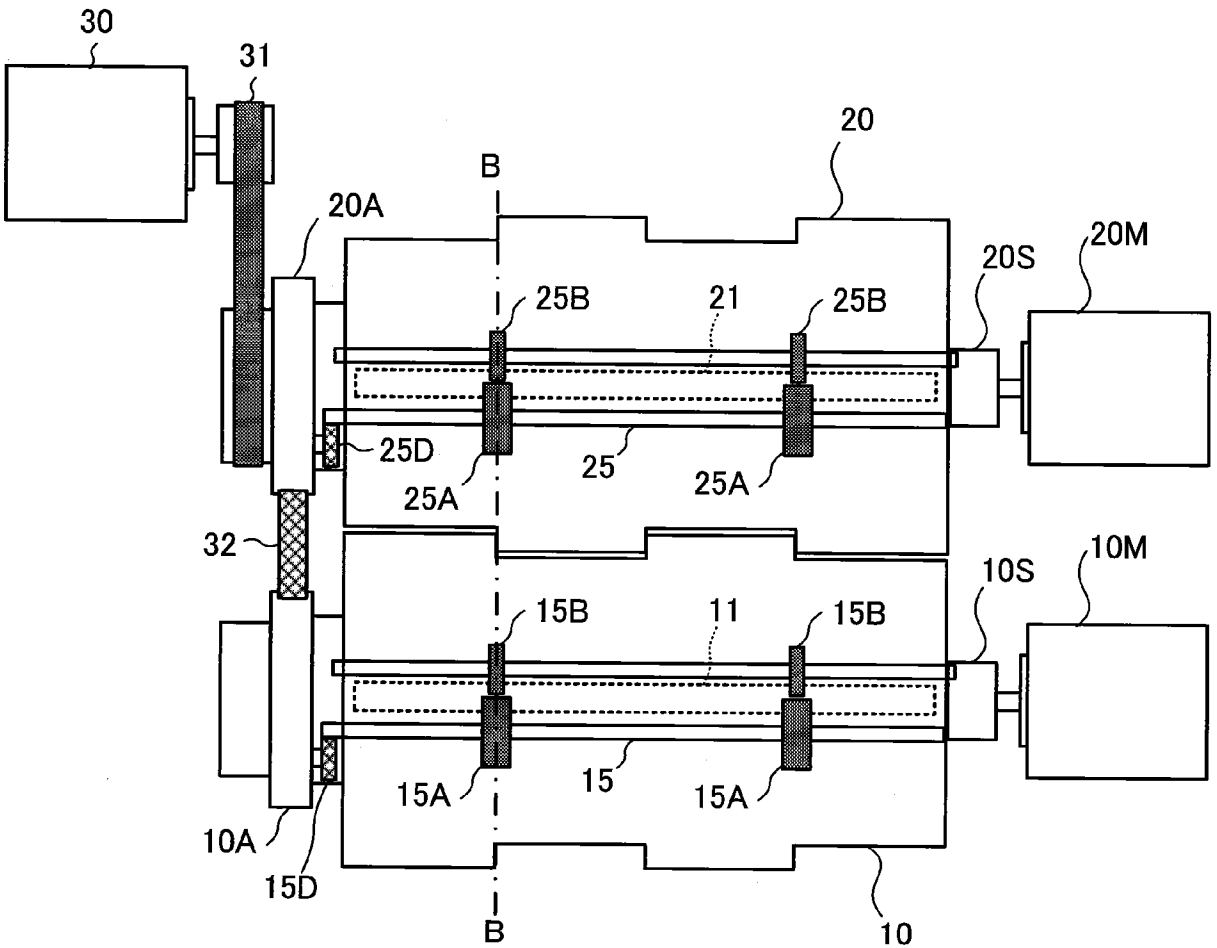

FIGS. 2A and 2B illustrate the conveying direction-switching device according to the present embodiment which uses two direction-changing drums. FIG. 2A is a plan view of the entire arrangement of the conveying direction-switching device, and FIG. 2B is a cross-sectional view of the arrangement of the gate of the direction-changing drums taken along B-B of FIG. 2A.

In this conveying direction-switching device, the two direction-changing drums 10 and 20 each having the hollow cylindrical shape as illustrated in FIG. 1 are disposed adjacent to each other, and in a state illustrated in FIGS. 2A and 2B by way of example, the respective phase angles thereof are controlled to position the direction-changing drums 10 and 20 such that the fourth opening 14 of the first direction-changing drum 10 is brought into surface contact with the second opening 22 of the second direction-changing drum 20. As described hereinabove with reference to FIG. 1, in these two direction-changing drums 10 and 20, the openings 11 to 13 are connected to the opening 14 by the three paper money conveying passages provided therein, respectively, and the openings 21 to 23 are connected to the opening 24 by the three paper money conveying passages provided therein.

Both of the two direction-changing drums 10 and 20 are formed such that they have a length corresponding to the lateral width of a paper money bill to be conveyed, and have respective circumferential protruded and recessed surfaces, which have a comb-like shape in cross-section and are complementary to each other, formed on the outer periphery thereof. Further, the first direction-changing drum 10 includes a phase control motor 10M for controlling the rotational angle position thereof to a predetermined phase angle about the axis of a rotation shaft 10S thereof. Further, the second direction-changing drum 20 also includes a phase control motor 20M for controlling the rotational angle position thereof to a predetermined phase angle about the axis of a rotation shaft 20S thereof, and the two direction-changing drums 10 and 20 are configured such that the phase angles thereof can be controlled independently of each other.

As illustrated in FIG. 2B, these two direction-changing drums 10 and 20 have the three openings 11 to 13 and 21 to 23 formed in the outer peripheries thereof, for conveying paper money bills therein, and the openings 14 and 24 formed in the same for discharging paper money bills therefrom. Further, the openings 11 to 14 and 21 to are each provided with paper money convey-in and convey-out mechanisms. The paper money convey-in mechanism of the opening 11, as illustrated in FIG. 2A, is provided with two sets of the drive rollers 15A and the pinch rollers 15B for conveying a paper money bill into the direction-changing drum 10, and the paper money bill is pinched between the drive rollers 15A and the pinch rollers 15B at two separate locations corresponding to steps in the protruded and recessed surface which has a comb-like shape in cross-section and then is conveyed therefrom into the direction-changing drum 10.

That is, a conveying motor 30 for driving the paper money convey-in mechanisms of the two direction-changing drums 10 and 20 transmits power to the drive gear 20A by a timing belt 31. The drive gear 20A is disposed at one axial end of the second direction-changing drum 20, and the power is transmitted from the drive gear 20A to the drive gear 10A of the first direction-changing drum 10 via a transmission gear 32. In the first direction-changing drum 10, a drive shaft 15 is driven in a predetermined rotational direction by the drive gear 10A via the transmission gear 15D, whereby the two drive rollers 15A is driven for rotation. This causes the paper money bill pinched between the drive rollers 15A and the pinch rollers 15B to be introduced into one of paper money-conveying paths inside the drum 10.

It should be noted that it is also possible to dispose two or more sets of drive rollers and pinch rollers for conveying paper money bills in, at the openings 11 to 14 and 21 to 24, as required, and this makes it possible to further positively convey paper money bills even when a paper money bill to be conveyed has wrinkles or deformation. Further, the outer peripheries of the two direction-changing drums 10 and 20 may be formed with protruded and recessed surfaces having a more finely defined comb-like shape in cross-section.

The phase control motor 20M is connected to the rotation shaft 20S of the second direction-changing drum 20 to thereby control the second direction-changing drum 20 to a predetermined phase angle about the axis of the rotation shaft 20S, whereby it is possible to align one of the openings 21 to 23 to the fourth opening 14 of the first direction-changing drum 10. At this time, for example, as illustrated in FIG. 2B, when the second direction-changing drum 20 is positioned such that the opening 14 of the first direction-changing drum 10 is brought into surface contact with the second opening 22 of the second direction-changing drum 20, a paper money bill conveyed into one of the three openings 11 to 13 of the first direction-changing drum 10 is conveyed into the opening 22 of the second direction-changing drum 20, and is further conveyed to the fourth opening 24 through a straight passage through the second direction-changing drum 20.

That is, when the conveying direction-switching device formed by closely arranging the two direction-changing drums 10 and 20 is in a state illustrated in FIG. 2B, the paper money bill conveyed from the first opening 11 into the first direction-changing drum 10 is conveyed to the fourth opening 24 of the second direction-changing drum 20, after turning the conveying direction thereof leftward by 90 degrees. Further, the paper money conveyed from the second opening 12 into the first direction-changing drum 10 continues to be conveyed straight forward to the fourth opening 24 of the second direction-changing drum 20, and the paper money conveyed from the third opening 13 into the first direction-changing drum 10 is conveyed after turning the conveying direction rightward by 90 degrees.

The conveying direction-switching device formed and operated as above has less component elements forming the conveying paths thereof, and makes it possible to reduce manufacturing process steps, and also facilitate the control of switching between the conveying paths. Further, in this conveying direction-switching device, the opening 14 of the first direction-changing drum 10 can be connected to any of the openings 21 to 23 of the second direction-changing drum 20, and hence it is possible to transfer the conveyed paper money bill to one of an increased variety of directions. In addition, the two direction-changing drums 10 and 20 have the outer peripheries, each of which has a protruded and recessed surface having a comb-like shape in cross-section, brought into surface contact with each other, and hence it is possible to reduce the possibility of occurrence of jamming of a paper money bill at the joint surface of the two openings.

Next, a description will be given of a conveying direction control method for switchingly controlling the direction of conveying a paper money bill.

Figure 4B:
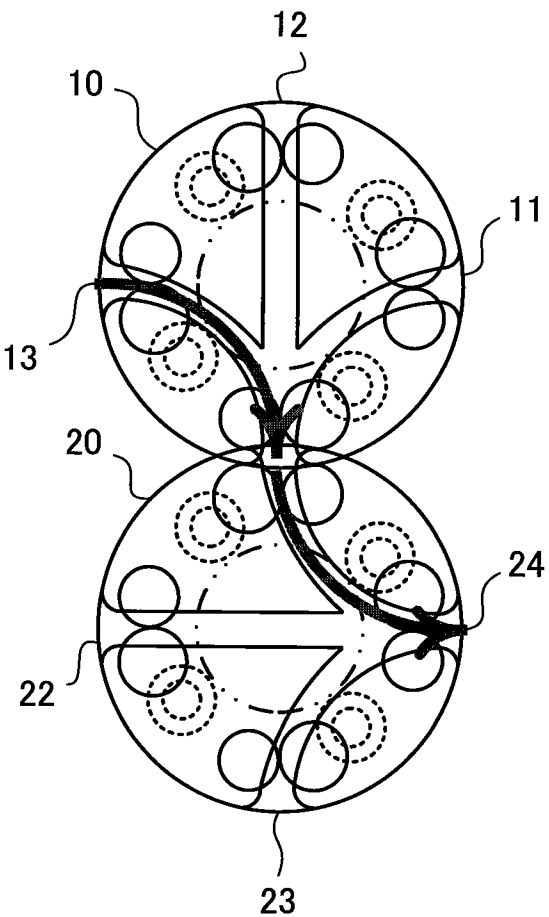
FIGS. 4A and 4B are views illustrating respective flows of a paper money bill from right above and left above to right below through selected ones of the various paper money-conveying paths formed by the two direction-changing drums arranged one on the other, by way of example.
Figure 4A:
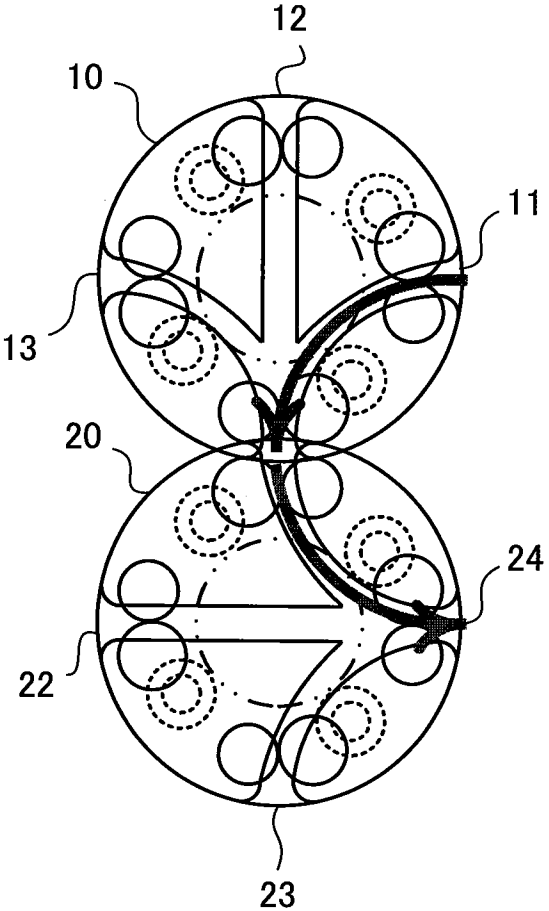
Figure 5C:
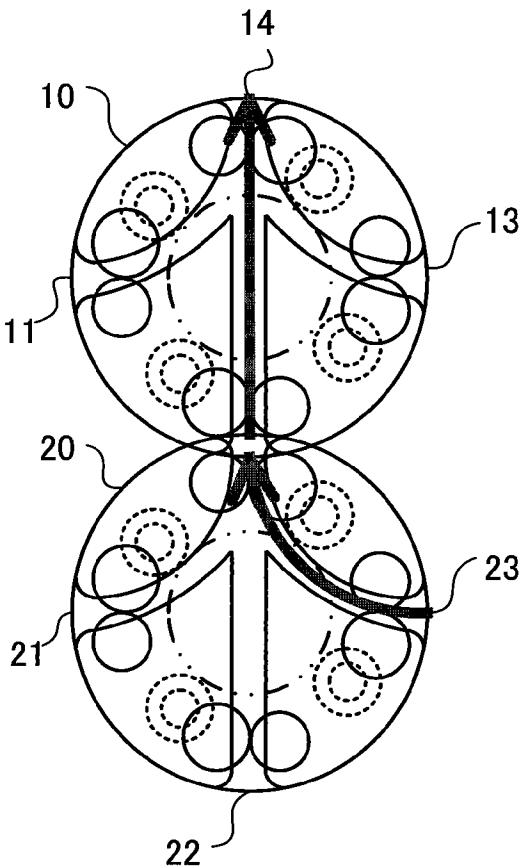
FIGS. 5A to 5C are views illustrating respective flows of paper money bills from below, right below and left below to above through selected ones of the various paper money-conveying paths formed by the two direction-changing drums arranged one on the other, by way of example.
Figure 5B:
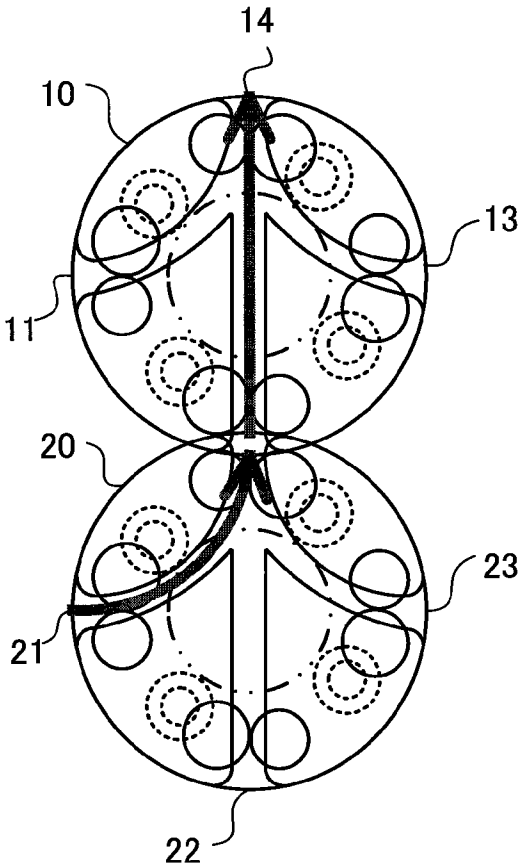
Figure 5A:
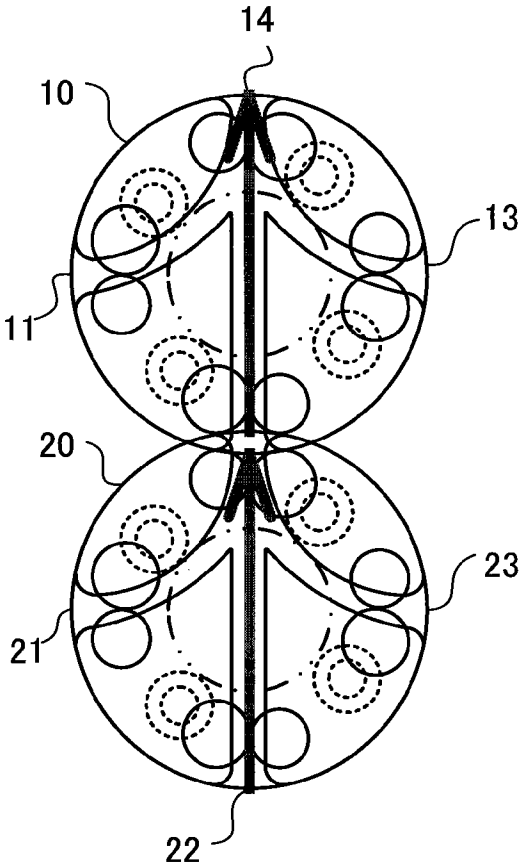

FIGS. 3A to 3C illustrate respective flows of paper money bills from above to right below, below, and left below through selected ones of various paper money-conveying paths formed by the two direction-changing drums arranged one on the other, by way of example. FIGS. 4A and 4B illustrate respective flows of paper money bills from right above or left above to right below through selected ones of the various paper money-conveying paths formed by the two direction-changing drums arranged one on the other, by way of example. FIGS. 5A to 5C illustrate respective flows of paper money bills from below, right below, and left below to above through selected ones of the various paper money-conveying paths formed by the two direction-changing drums arranged one on the other, by way of example.

In these drawings, the two direction-changing drums 10 and 20 are arranged one on the other to thereby provide the paper money-conveying paths for switching the direction of conveying a paper money bill. Now, let it be assumed that a paper money bill is conveyed in from above as viewed in FIG. 3, i.e. from the opening 12 into the first direction-changing drum 10, and only the phase angle of the second direction-changing drum 20 on the discharge side is controlled to thereby switch the conveying direction.

Now, if the phase angle of the second direction-changing drum 20 is controlled such that it is placed in a state illustrated in FIG. 3A, the paper money bill conveyed from above as viewed in FIG. 3A into the first direction-changing drum 10 is conveyed to the opening 21 of the second direction-changing drum 20 through the straight passage. Then, the conveying direction is switched to the right direction as viewed in FIG. 3A in the second direction-changing drum 20, and the paper money is discharged from the opening 24.

Next, as illustrated in FIG. 3B, the phase angle of the second direction-changing drum 20 is controlled to a state rotated clockwise by 90 degrees. In this case, the paper money conveyed into the first direction-changing drum 10 from above as viewed in FIG. 3B is conveyed to the opening 22 of the second direction-changing drum 20 through the straight passage, and continues to be conveyed straight forward also through the second direction-changing drum 20 to be discharged from the opening 24.

The state illustrated in FIG. 3C shows a case where the phase angle of the second direction-changing drum 20 is further rotated clockwise by 90 degrees, for control of the paper money-conveying path. In this state, the paper money carried into the first direction-changing drum 10 from above as viewed in FIG. 3C is conveyed to the opening 23 of the second direction-changing drum 20 through the straight passage. Then, the conveying direction is switched to the left direction as viewed in FIG. 3C in the second direction-changing drum 20, and the paper money bill is discharged from the opening 24.

FIG. 4A illustrates a flow of a paper money bill conveyed into the first direction-changing drum 10 disposed on a convey-in side from right as viewed in FIG. 4A, i.e. from the opening 11, when the two direction-changing drums 10 and 20, arranged one on the other, are each controlled to the same phase as illustrated in FIG. 3A. At this time, the paper money conveying direction is turned by 90 degrees in each of the two direction-changing drums 10 and 20, so that the conveying direction is changed by 180 degrees by the two direction-changing drums 10 and 20. Further, FIG. 4B illustrates a flow of a paper money bill conveyed into the first direction-changing drum 10 from left as viewed in FIG. 4B, i.e. from the opening 13. Thus, by controlling the phases of the two direction-changing drums 10 and 20, arranged one on the other, it is possible to convey a paper money conveyed in from either left above or right above to right below.

FIGS. 5A to 5C illustrate respective flows of paper money bills when each paper money bill is conveyed into the second direction-changing drum 20 disposed at a lower location as viewed in FIGS. 5A to 5C. In FIGS. 5A to 5C, the first direction-changing drum 10 is set as the discharge side and has its phase controlled to a state rotated from the state illustrated in FIGS. 4A and 4B by 180 degrees, and the second direction-changing drum 20 is rotated anticlockwise from the state illustrated in FIGS. 4A and 4B by 90 degrees, whereby the respective phases of the direction-changing drums are controlled such that the paper money conveying direction is set to an upward direction as viewed in FIG. 5. In FIG. 5A, a paper money bill conveyed into the second direction-changing drum 20 from the opening 22 is conveyed to the opening 12 of the first direction-changing drum 10 through the straight passage, and continues to be also conveyed straight forward through the first direction-changing drum 10 to be discharged from the opening 14.

Further, as illustrated in FIG. 5B, assuming that a paper money bill is conveyed into the second direction-changing drum 20 disposed on the convey-in side from left as viewed in FIG. 5B, i.e. from the opening 21, the paper money bill is conveyed from left below to the upward direction by the two direction-changing drums 10 and 20 disposed one above the other. Further, as shown illustrated in FIG. 5C, assuming that a paper money bill is conveyed into the second direction-changing drum 20 from right as viewed in FIG. 5C, i.e. from the opening 23, the paper money bill is conveyed from right below to the upward direction.

As described above, in the conveying direction-switching device formed by the two direction-changing drums 10 and 20, arranged one on the other, the paper money is discharged from the opening 14 or 24 by selecting the direction of conveying a paper money bill conveyed in from any of the openings 11 to 13 and the openings 21 to 23 to one of a plurality of directions dependent on the respective phase angles of the direction-changing drums 10 and 20. Therefore, it is possible to easily perform the switching control of the conveying paths only by controlling the phases of the direction-changing drums 10 and 20 using the respective phase motors. Further, when the conveying direction-switching device is applied to a paper money processor, described hereafter, it is possible to reduce the production costs without complicating the whole conveying mechanism.

Next, a description will be given of the paper money processor formed by using the above-described conveying direction switching device.

Figure 6:
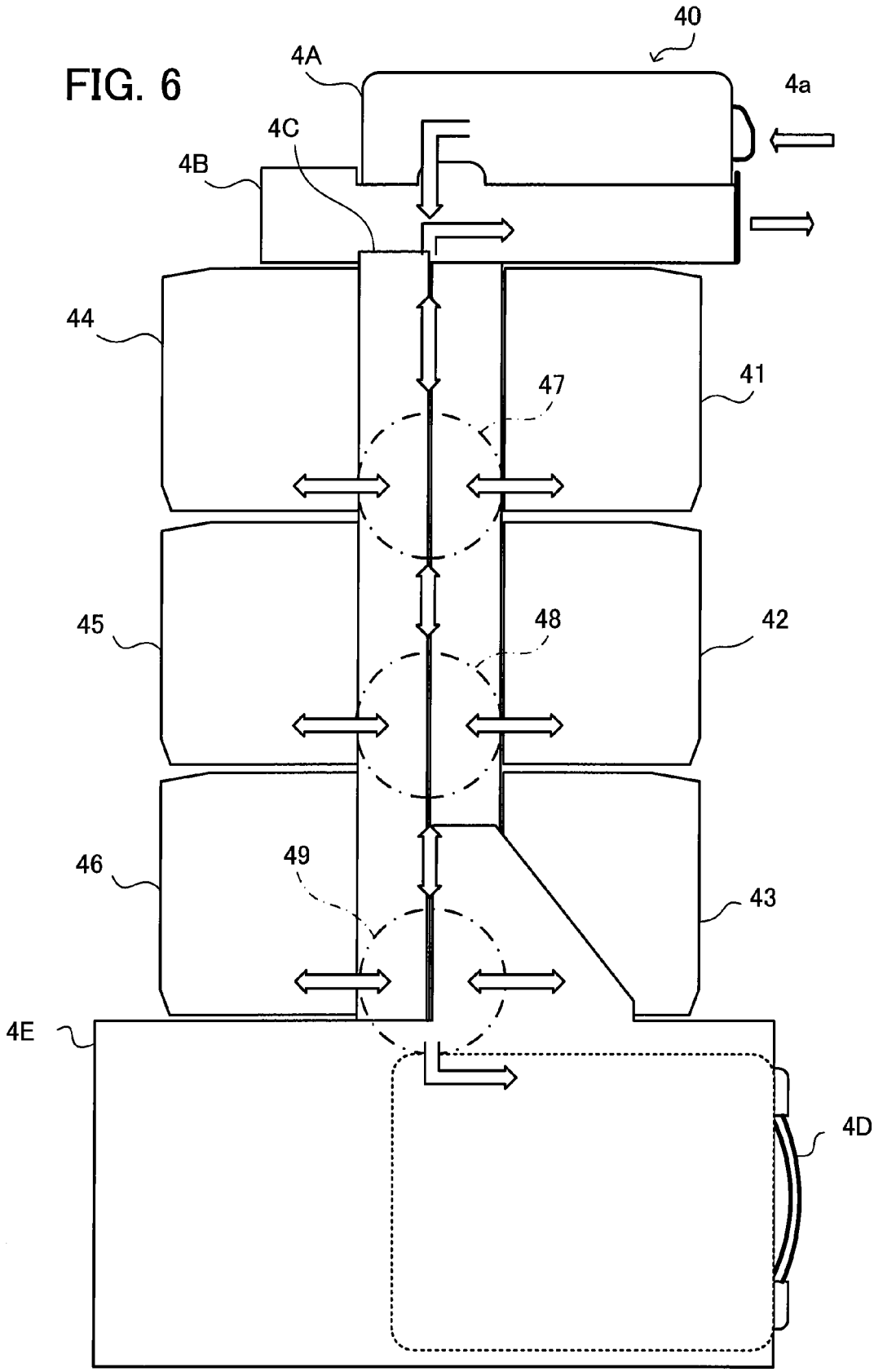
FIG. 6 illustrates an example of a paper money processor formed by three direction-changing drums.

FIG. 6 illustrates an example of a paper money processor formed by three direction-changing drums.

A paper money processor 40 comprises an identification section 4A having a slot 4*a* for inserting paper money, a money dispensing section 4B for controlling the dispensing of paper money, a conveying path 4C for conveying paper money, to which are connected recycle storage sections 41 to 46 for storing paper money according to types thereof, and a device base section 4E on which a stacker 4D for collecting paper money is mounted in a removable manner. In this processor, the recycle storage sections 41 to 43, and 44 to 46 are vertically arranged at three levels on the opposite sides of the conveying path 4C, and the direction of conveying a paper money bill in the conveying path 4C in upward and downward directions is controlled by the three direction-changing drums 47 to 49. It should be noted that the device base section 4E is provided with a control panel for the control of operations for receiving, dispensing, and collecting paper money, and a controller of the control panel, in addition to the stacker 4D.

In the paper money processor 40, the type and authenticity of each of inserted paper money bills are identified by the identification section 4A, and only authentic ones are each carried into the conveying path 4C. In the three direction-changing drums 47 to 49, the downward conveyance of a paper money bill is controlled such that the conveying direction thereof is switched to one of the right, left, and lower directions according to the type thereof, to store the paper money bill in one of the recycle storage sections 41 to 46 according to the type of the paper money bill. For example, when any of the recycle storage sections 41 to 46 is filled with paper money bills associated therewith, the paper money bills are conveyed out via an associated one of the three direction-changing drums 47 to 49 into the conveying path 4C again, and are stored in the stacker 4D of the device base section 4E. Further, if dispense from the money dispensing section 4B is requested, a predetermined type of paper money is selected from the associated recycle storage sections 41 to 46, and is discharged via an associated one of the three direction-changing drums 47 to into the money dispensing section 4B through the conveying path 4C.

In the paper money processor 40 configured as above, it is possible to arrange the three direction-changing drums 47 to 49, as illustrated in FIG. 6, in a vertically stacked manner, as a drum assembly within the conveying path 4C extending from the device base section 4E over a predetermined length. In that case, the length of the conveying path is determined depending e.g. on the size or number of recycle storage sections disposed on the opposite sides of the conveying path. Therefore, as for how the direction-changing drums are combined and disposed in the conveying path, a paper money processor may be designed according to the needs of a customer who needs to provide the paper money processor. That is, the size and number of direction-changing drums, how to combine them with the straight conveying path, and so forth, can be determined depending on the number of recycle storage sections and the capacity (size) of the paper money processing.

Also in a case where the present embodiment is applied to a paper leaves processor which processes paper leaves, such as various kinds of cards, besides the paper money processing, it is possible to obtain the same advantageous effects.

Further, although the conveying direction-switching device 1 in FIG. 1 has been described as the combination of the two direction-changing drums 10 and 20, it is possible to separately use the direction-changing drums 47 to 49, as in the case of the paper money processor 40 illustrated in FIG. 6. In this case, depending on the length of the conveying path 4C and the size of the direction-changing drums 47 to 49, it is also possible to form the conveying path 4C only by three direction-changing drums 47 to 49.

According to the present embodiment, by using direction-changing drums as a conveying gate, a conveying path can be formed which makes it possible to switch the conveying direction using the direction-changing drums alone. That is, the conveying gate is formed by disposing a plurality of direction-changing drums, one upon another, on an as-needed basis, and hence it is possible to realize the conveying direction-switching device which can dispense with a complicated gate mechanism and pathway for paper leaves. Therefore, by using the conveying direction-switching devices according to the present invention in combination, it is possible to realize a paper leaves processor which can easily cope with an increase or decrease of the processing capacity (capacity of cassettes) of a paper leaves storage section.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention has(have) been described in detail, it should be understood that various changes, substitutions, and alterations could be made hereto without departing from the spirit and scope of the invention.

What is claimed is:

1. A conveying direction-switching device that switches the direction of conveying paper leaves, comprising, a direction-changing drum configured to have a plurality of openings formed in an outer periphery thereof for permitting a paper leaf to be conveyed therein and be conveyed therefrom, and have a plurality of conveying paths formed therein for connection between the openings; and a phase control unit configured to control said direction-changing drum to a predetermined phase angle about a rotational axis thereof, to thereby cause one of the openings to be aligned with a conveying direction of the paper leaf conveyed into said direction-changing drum, wherein one of a plurality of directions is selected as the direction of conveying the paper leaf to be discharged from one of the openings according to the predetermined phase angle of said direction-changing drum;

wherein said direction-changing drum comprises:

the phase control unit is configured to be capable of controlling said direction-changing drum to the predetermined phase angle about the rotational axis thereof;

first to fourth openings, as said plurality of openings, each of which is configured to have a slit shape which is parallel to the rotational axis, said first to fourth openings being arranged in this order on the outer periphery of said direction-changing drum in a manner spaced from each other by 90 degrees about the rotational axis thereof;

convey-in rollers which are disposed in respective vicinities of the first to third openings of said direction-changing drum;

a convey-out roller which is disposed in a vicinity of the fourth opening of said direction-changing drum;

a straight passage configured to extend through the rotational axis of said direction-changing drum and connect the fourth opening and the second opening; and first and second curved passages intersecting with both sides of the straight passage in the direction-changing drum to form the shape of an arrowhead with the straight passage, configured to extend through said direction-changing drum and connect the fourth opening and the first opening, and the fourth opening and the third opening, respectively, and wherein the paper leaf is conveyed in via one of the first to third openings and is discharged to the fourth opening, whereby the direction of conveying the paper leaf is switched.

2. The conveying direction-switching device according to claim 1, comprising a set of said direction-changing drums disposed adjacent to each other, each of said direction-changing drums having a protruded and recessed surface formed on the outer periphery thereof such that said protruded and recessed surface has a comb shape in cross-section, and wherein respective selected openings of said direction-changing drums are connected to each other in a manner brought into surface contact with each other, whereby the paper leaf is conveyed therethrough.

* * * * *